US007140051B2

(12) United States Patent
Fort et al.

(10) Patent No.: US 7,140,051 B2
(45) Date of Patent: Nov. 28, 2006

(54) DRY SUCTION FITTING ASSEMBLY

(75) Inventors: Erik A. Fort, Anaheim, CA (US); Chris H. McDonald, Yorba Linda, CA (US)

(73) Assignee: ITT Corporation, Chicago, IL (US)

( * ) Notice: Subject to any disclaimer, the term of this patent is extended or adjusted under 35 U.S.C. 154(b) by 0 days.

(21) Appl. No.: 11/255,590

(22) Filed: Oct. 21, 2005

(65) Prior Publication Data

US 2006/0107452 A1 May 25, 2006

Related U.S. Application Data

(60) Provisional application No. 60/621,137, filed on Oct. 22, 2004.

(51) Int. Cl.
*E04H 4/00* (2006.01)

(52) U.S. Cl. ..... 4/509; 417/38

(58) Field of Classification Search ..... 4/507, 4/509; 417/38

See application file for complete search history.

(56) References Cited

U.S. PATENT DOCUMENTS 4,861,231 A * 8/1989 Howard ..... 417/38

6,912,739 B1 * 7/2005 Nowell ..... 4/507

FOREIGN PATENT DOCUMENTS

WO WO 96/18335 6/1996

* cited by examiner

*Primary Examiner*—Charles E. Phillips

(57) ABSTRACT

A dry suction fitting assembly is provided for drawing water from a spa, whirlpool bathtub or other suitable water tub to a pump, featuring a suction body for arranging in relation to a wall of the spa, whirlpool bathtub or other suitable water tub. The suction body is arranged in relation to a wall of the spa, whirlpool bathtub or other suitable water tub, has a suction inlet for coupling to the pump, and has an internal surface with an equilibrium tube arranged therein with three openings, a first opening that acts as a water flow inlet, a second opening that is open to the atmosphere via a connection hose or other suitable connection device and that is filled with water during normal operation, and a third opening that is a safety orifice coupled to the suction inlet. During normal operation water flows from the first opening, through the equilibrium tube, and out the third opening. During a blockage when water stops flowing through the suction body to the suction inlet and water pressure decreases, water in the equilibrium tube evacuates out the third opening, and air is drawn from the atmosphere through the second opening and out the third opening, causing the pump to cavitate so the blockage may be removed.

22 Claims, 7 Drawing Sheets

DRY SUCTION FITTING ASSEMBLY

CROSS-REFERENCE TO RELATED PATENT APPLICATIONS

This application claims benefit to provisional patent application Ser. No. 60/621,137, filed 22 Oct. 2004, which is hereby incorporated by reference in its entirety.

BACKGROUND OF THE INVENTION

1. Technical Field

The present invention relates to spas and whirlpools generally and suction fittings or assemblies specifically located on the bottom or sides of the spa or whirlpool bathtub through which water flows either by gravity while draining or by a pump that sucks water through the suction fittings and returns to the spa or whirlpool bath via plumbing and other fittings.

2. Description of Related Art

Spas and whirlpool tubs are designed to offer a therapeutic effect on users by circulating and forcing water or a water/air mixture into the enclosure. A pump pulls water through the suction fitting and forces the water through jets where air may be mixed, attached to the bottom or sides of the spa or whirlpool bathtub. There is a problem in the known spas and whirlpools related to the dangers associated with hair entanglement or body entrapment in the aforementioned system, in particular in some known spas or whirlpools which include overlapping coaxial tubes that form an air flow path. The space between tubes permits easy clogging. In operation, the pump pulls water from the spa or bathtub through the suction fitting creating a force that attracts free-flowing objects such as hair and other objects that are nearby such as part of a person's body. When an object blocks the flow, the vacuum pressure approaches 29.9 inches Hg (14.7 psi) and may remain high if there is no means to free the object or disable the pump. This could result in panic, discomfort, pain or death of the user.

There is also a problem with known spas and whirlpools related to water retention. For example, in the Whirlpool Bathtub Industry there is a desire to reduce the amount of water that a plumbing system and all its components will retain after the bathtub is drained. This desire is linked to the fact that water left stagnant for a period of time is a ripe breeding ground for growing bacteria of varying types. Some are harmful to humans and some just noxious. Therefore, the effort to reduce retention of water after drawing in a whirlpool bathtub environment is very important to the manufacturers of whirlpool bathtubs and also to the end user.

SUMMARY OF THE INVENTION

The present invention provides a solution to the "hair entanglement" problem by using a pressure equilibrium tube having three openings. The first opening acts as a water flow inlet. The second opening is open to the atmosphere via, for example, a connected hose. The third opening is a safety orifice open to a suction inlet of the pump. In operation, when the flow stops due to blockage, the water pressure decreases. Water in the tube evacuates and air is drawn from the atmospheric opening and out the safety orifice. The pump cavitates, the suction force goes to zero, the blockage may be removed, and normal operation may resume seconds later. The present invention eliminates the need for overlapping coaxial tubes and the face tube entirely that are used in the prior art. During normal operation, the conical feature allows a high pressure at the safety opening where otherwise a Venturi effect can draw air prematurely at high flow rates. In normal operation, water may flow through the equilibrium tube and out the safety orifice.

The present invention provides a solution to the "water retention" problem by using an elbow fitting with angled surfaces that connects from the inside of the tub, thus eliminating the need of a screw-type wall fitting used in other models that prohibits complete drainage. The fitting is secured with a nut that attaches from the outside of the wall and is sealed with an o-ring rather than the flat or L-gasket commonly used in the present technology.

One advantage of the present invention is that it eliminates the need for a spring, level sensors, switches, other moving or electrical devices, overlapping coaxial tubes and a face tube all together. Moreover, the present invention allows for nearly complete drainage by eliminating the screw-type wall fitting associated with all other known suction devices. The fitting extends from an exterior tub wall approximately 0.43 inches less than the known HydraBaths and 0.36" less than the known GG device. In the present invention, the suction cover is molded with simple cavity-core mold—no slides required. In comparison, the known GG device requires extra fittings, connectors and tubing, which mean a longer assembly time, and more potential failure modes or leak paths. The present invention also utilizes an O-ring rather than a flat or L-gasket. The O-ring seal reduces the force required to tighten the nut, which decreases assembly time. Also, it is more robust than the flat or L-gasket because for a given force and material the compression is greater for a circular cross-sectional seal than for a rectangular cross-section seal such as flat or L-gasket.

BEST MODE FOR CARRYING OUT THE INVENTION

The present invention provides a new and unique dry suction fitting assembly generally indicated as 10 for drawing water from a spa, whirlpool bathtub or other suitable water tub (not shown) to a pump (not shown).

Figure 1:
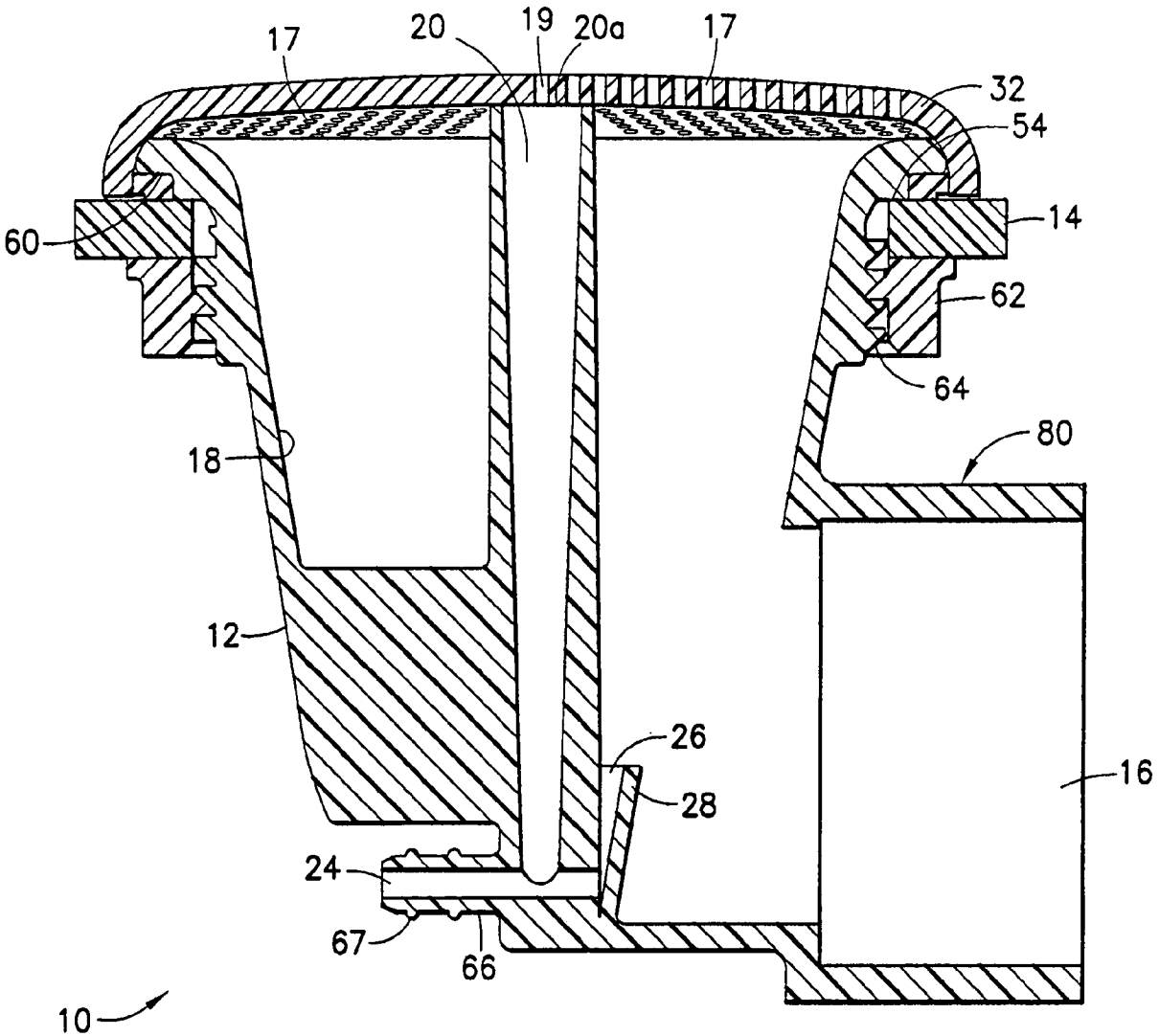
FIG. 1 is a cross-sectional view of the dry suction fitting assembly according to the present invention.
Figure 2:
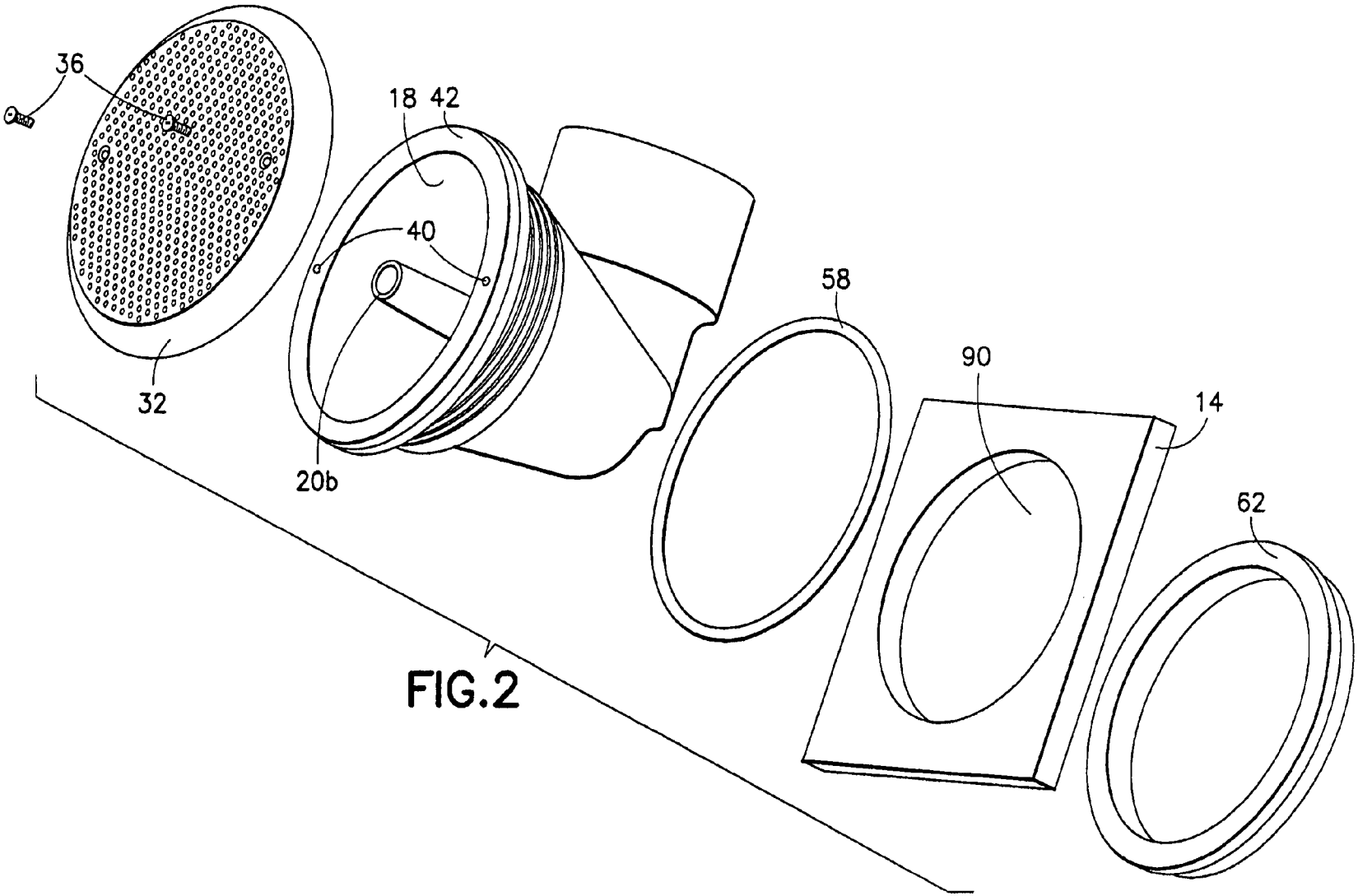
FIG. 2 is an exploded isometric view of the dry suction fitting assembly according to the present invention.

As shown in FIGS. 1–2, the dry suction fitting assembly 10 features a suction body 12 for arranging in relation to a wall 14 of the spa, whirlpool bathtub or other suitable water tub (not shown), having a socket or suction inlet 16 for coupling to the pump (not shown), and having an internal surface 18 with an equilibrium tube 20 arranged therein with three openings 20*a*, 24, 26, including a first opening 20*a* that acts as a water flow inlet, a second opening 24 that is open to the atmosphere via a connection hose or other suitable connection device (for example, see element 68 in FIG. 7) and that is filled with water during normal operation, and a third opening 26 that is a safety orifice coupled to the suction inlet 16. During normal operation, water flows from the first opening 20*a*, through the equilibrium tube 20, and out the third opening 26. In comparison, during a blockage when water stops flowing through the suction body 12 to the suction inlet 16 and water pressure decreases, water in the equilibrium tube 20 evacuates out the third opening 26, and air is drawn from the atmosphere through the second opening 24 and out the third opening 26, causing the pump (not shown) to cavitate so the blockage (not shown) may be removed.

The internal surface 18 has a conical member 28 arranged in relation to the third opening 26 that allows a high pressure at the third opening 26 to prevent premature air flow through the third opening 26 during normal operation. The conical member 28 has about a 10 degree slope to prevent water retention in the equilibrium tube 20, although embodiments are envisioned using slopes having different degrees. As shown, the internal surface 18 has a conical shape that allows water to drain by gravity once the water has left the main pipe area of the suction body 12, for example, when the water in the spa, whirlpool bathtub or other suitable water tub is drained. However, the scope of the invention is intended to include the internal surface 18 having other shapes to achieve the desired draining functionality.

The dry suction fitting assembly 10 includes a tube or hose 68 (see FIG. 7) coupled to the second opening 24 whose opposite end is above the maximum water level. By way of example, the tube 68 may be arranged inside the housing of the spa, whirlpool bathtub or other suitable water tub and affixed so that its opposing end (end not coupled to the opening 24) is arranged above the water level of the spa, whirlpool bathtub or other suitable water tub.

Figure 3:
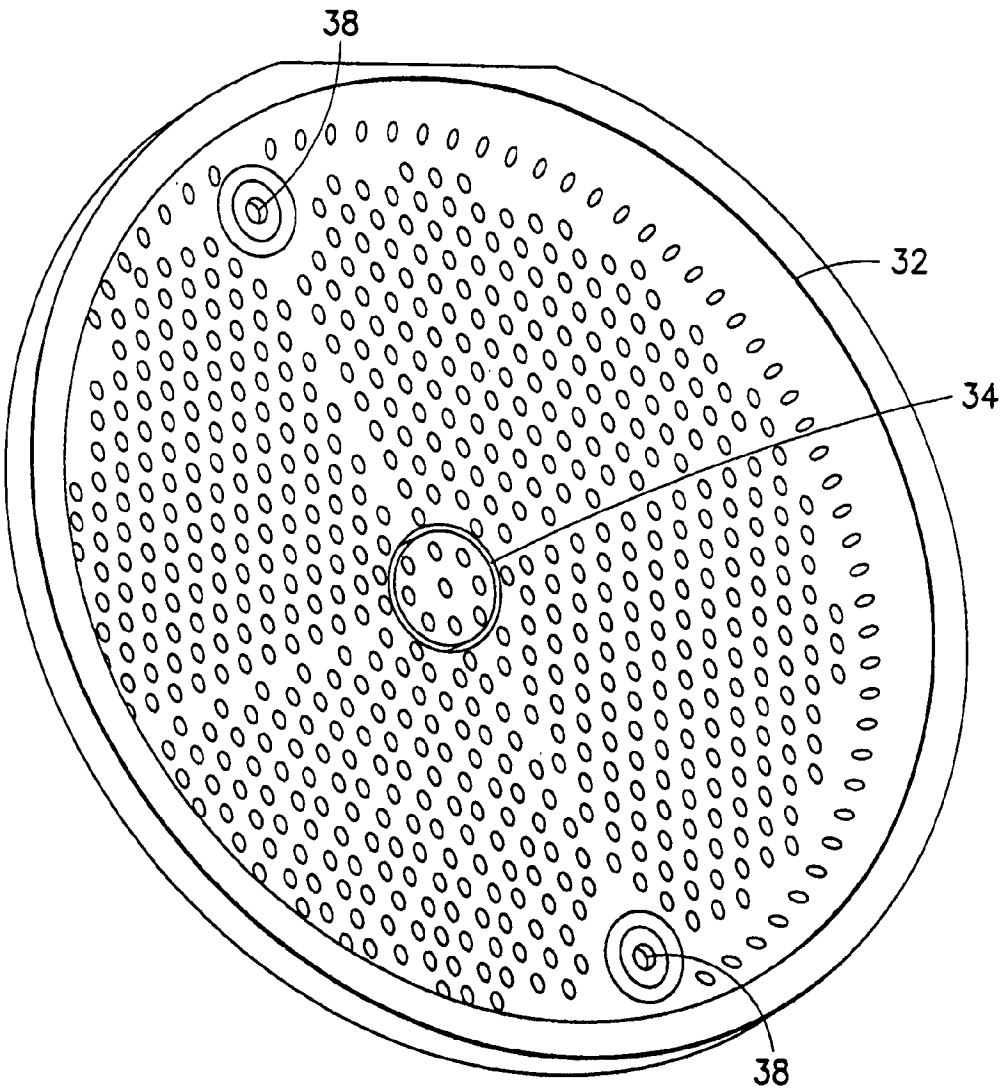
FIG. 3 is an isometric view of a dry suction cover shown in FIGS. 1–2.
Figure 4:
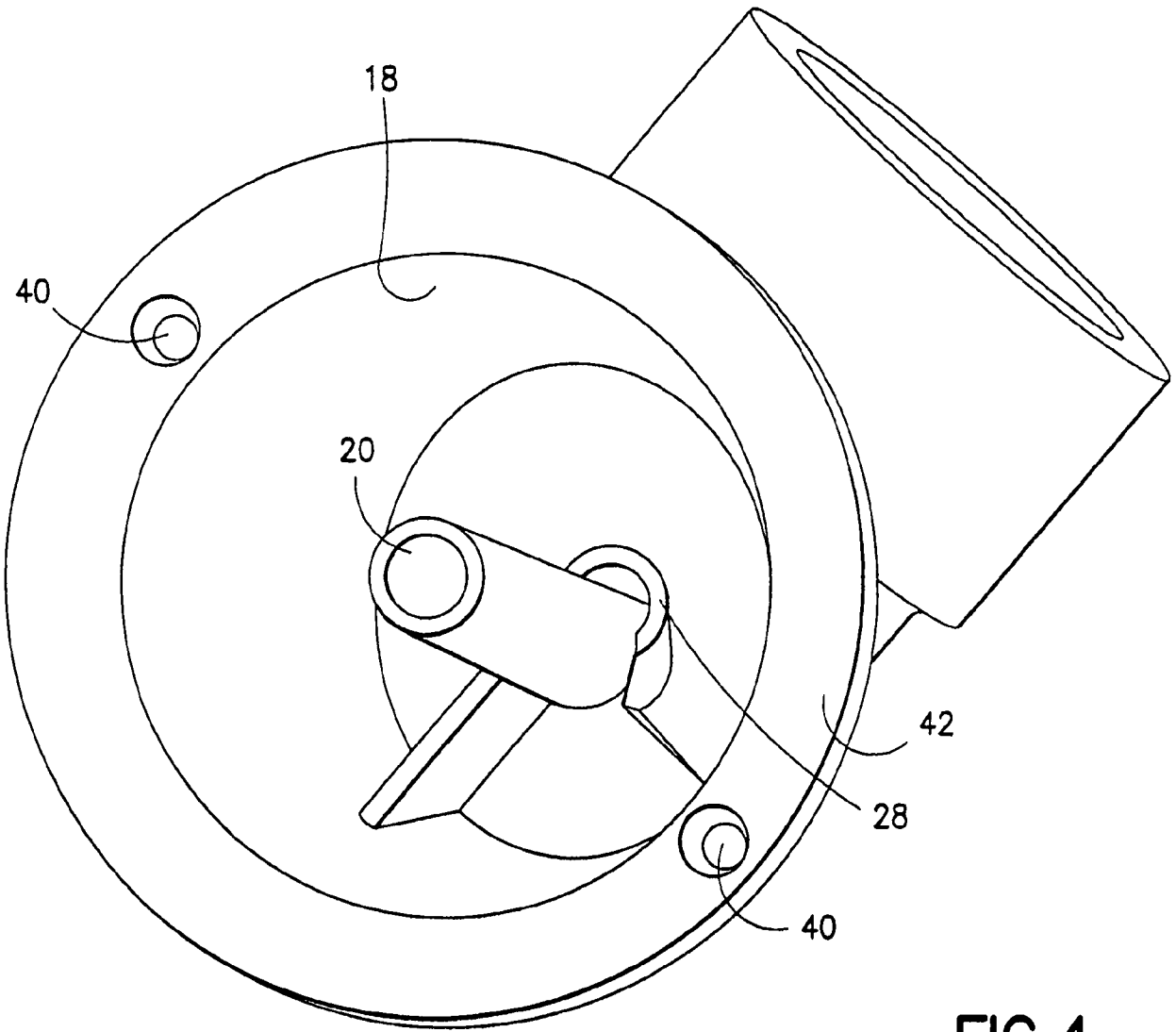
FIG. 4 is an isometric view of a dry suction elbow shown in FIGS. 1–2.

The dry suction fitting assembly 10 may also have a suction cover 32 shown in FIGS. 1–3 arranged on an annular rim 42 of the suction body 12. The suction cover 32 has a multiplicity of holes, openings or orifices 17 for allowing water to pass into the suction body 12. The suction cover 32 may also include an internal groove 34 (see FIG. 3) for coupling to an annular rim 20*b* (see FIG. 3) of the equilibrium tube 20. The suction cover 32 may be made of acrylonitrile-butadiene-styrene (ABS), although the scope of the invention is not intended to be limited to any particular type or kind of material. For example, embodiments are envisioned using other materials either now known or later developed in the future, including any of a class of plastics based on ABS copolymers. The dry suction fitting assembly 10 may also include one or more fasteners 36, each for passing through a respective opening 38 (FIG. 3) in the suction cover 32 and into a corresponding opening 40 (FIG. 4) in the annular rim 42 of the suction body 12, for coupling the suction cover 32 to the suction body 12. The fasteners 36 may take the form of one or more stainless steel screws, although the scope of the invention is not intended to be limited to any particular type or kind of fastener or the material from which the fastener is made.

Figure 5A:
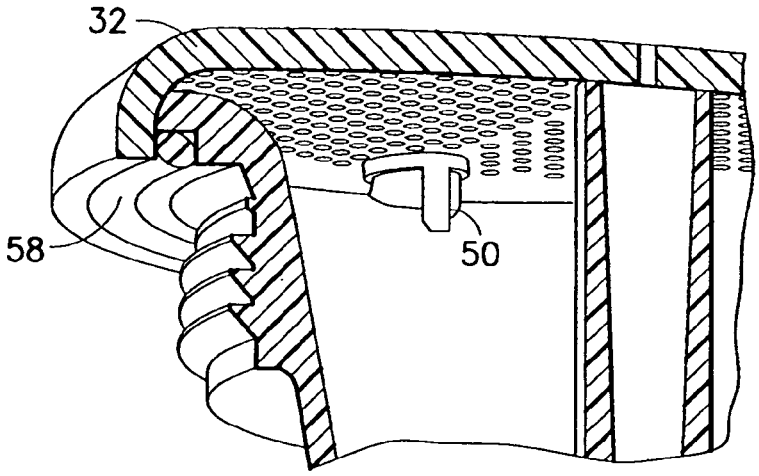
FIG. 5, including FIGS. 5(*a*), (*b*) and (*c*), show new male and female alignment features on the cover and elbow of an alternative embodiment of the present invention.
Figure 5B:
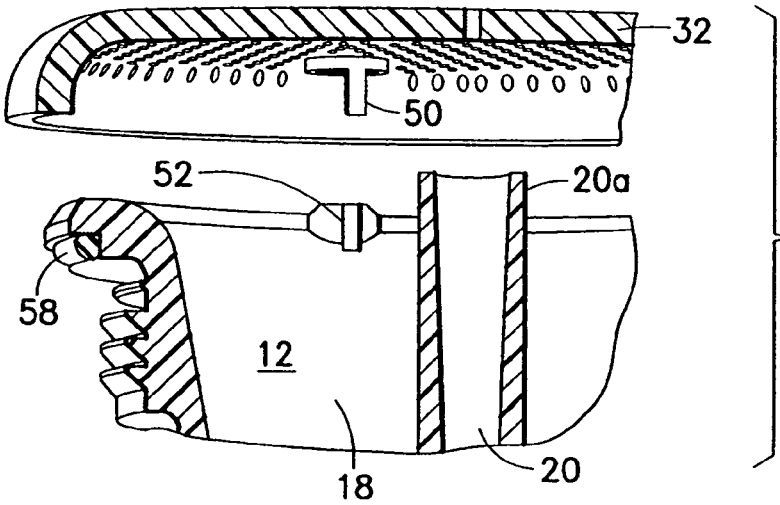
Figure 5C:
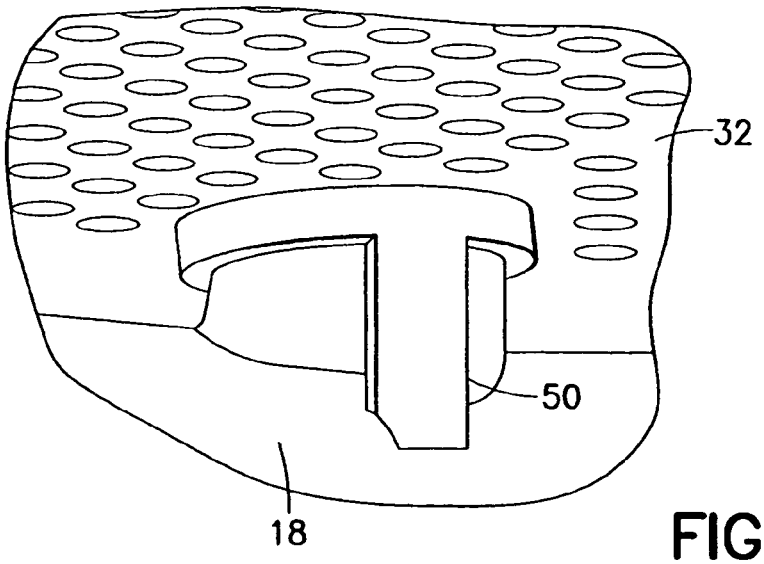

As shown in FIG. 5, the suction cover 32 may include one or more male alignment members 50, each for coupling to a respective female alignment member 52 in the annular rim 42 of the suction body 12 for orienting the suction cover 32 in relation to the suction body 12.

Figure 6B:
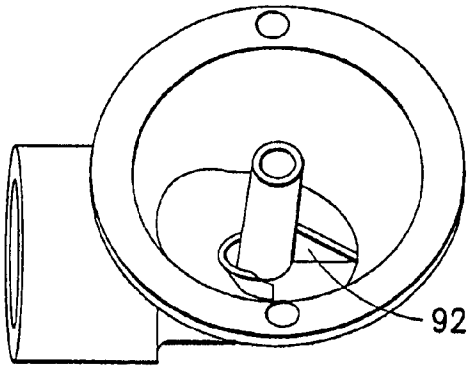
FIG. 6, including FIGS. 6(*a*), (*b*), (*c*) and (*d*), show other new features on the alternative embodiment of the present invention, including a rib shape change to allow for water drainage, a hose retainer feature and O-ring retainer ribs that prevent the O-rings from falling off during installation.

As best shown in FIGS. 1, 2, 5 and 6, the suction body 12 may also include one or more annular rims 54 for seating the suction body 12 in relation to the wall 14 of the spa, whirlpool bathtub or other suitable water tub (not shown), as well as an O-ring 58 or other suitable gasket for arranging between an annular rim or groove 60 of the suction body 12 and the wall 14 of the spa, whirlpool bathtub or other suitable water tub. The dry suction fitting assembly 10 also includes a nut or other suitable fastening device 62 for cooperating with threads or other suitable retaining member 64 of the suction body 12 for coupling the suction body 12 to the wall 14 of the spa, whirlpool bathtub or other suitable water tub (not shown). The nut 62 may be made of PVC, although the scope of the invention is not intended to be limited to any particular type or kind of material. For example, embodiments are envisioned using other materials either now known or later developed in the future, including any of a class of PVC copolymers. The suction body 12 also has a barb 66 forming the second opening 24 and adapted for receiving the tube 68 (FIG. 7) thereto. The barb 66 also has ribs 67 for stretching and gripping the tube 68 when it is affixed on the barb 66. As best shown in FIGS. 6*c* and 7, the suction body 12 also has one or more hose retaining member 70, that may take the form of knife-like teeth, arranged in relation to the barb 66 for frictionally engaging the tube 68 and preventing the same from pulling away from the barb 66, as best shown in the assembly 10' shown in FIG. 7. The suction body 12 also has a barb protecting member 72 arranged in relation to the barb 66 for protecting the same.

As shown in FIG. 1, the axis of the internal surface is arranged perpendicular to the axis of the suction inlet so as to form an L-shaped suction body generally indicated as 80.

By way of example, the O-ring may be made of Buna N, EPDM or Viton, and the suction body may be made of polyvinylchloride (PVC), although embodiments are envisioned using other types and kinds of materials.

Figure 6D:
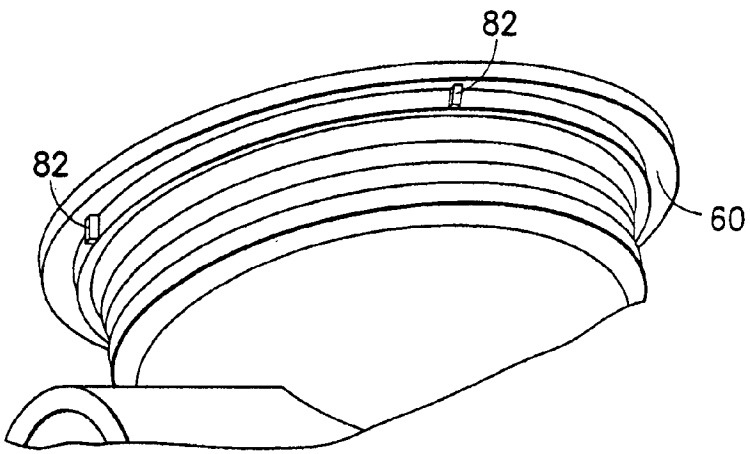
Figure 6A:
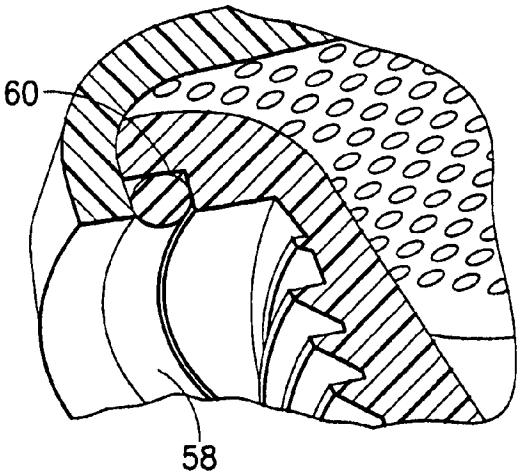
Figure 6C:
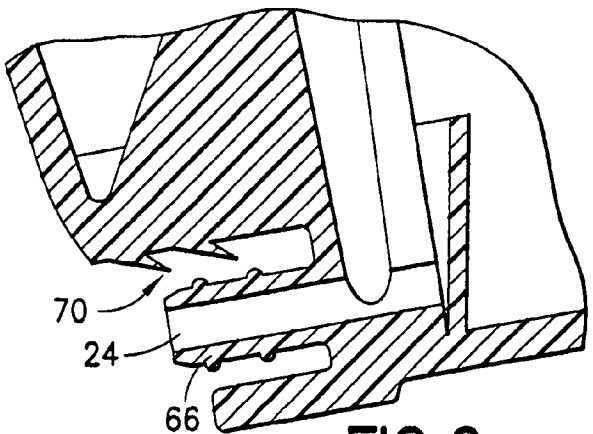
Figure 7:
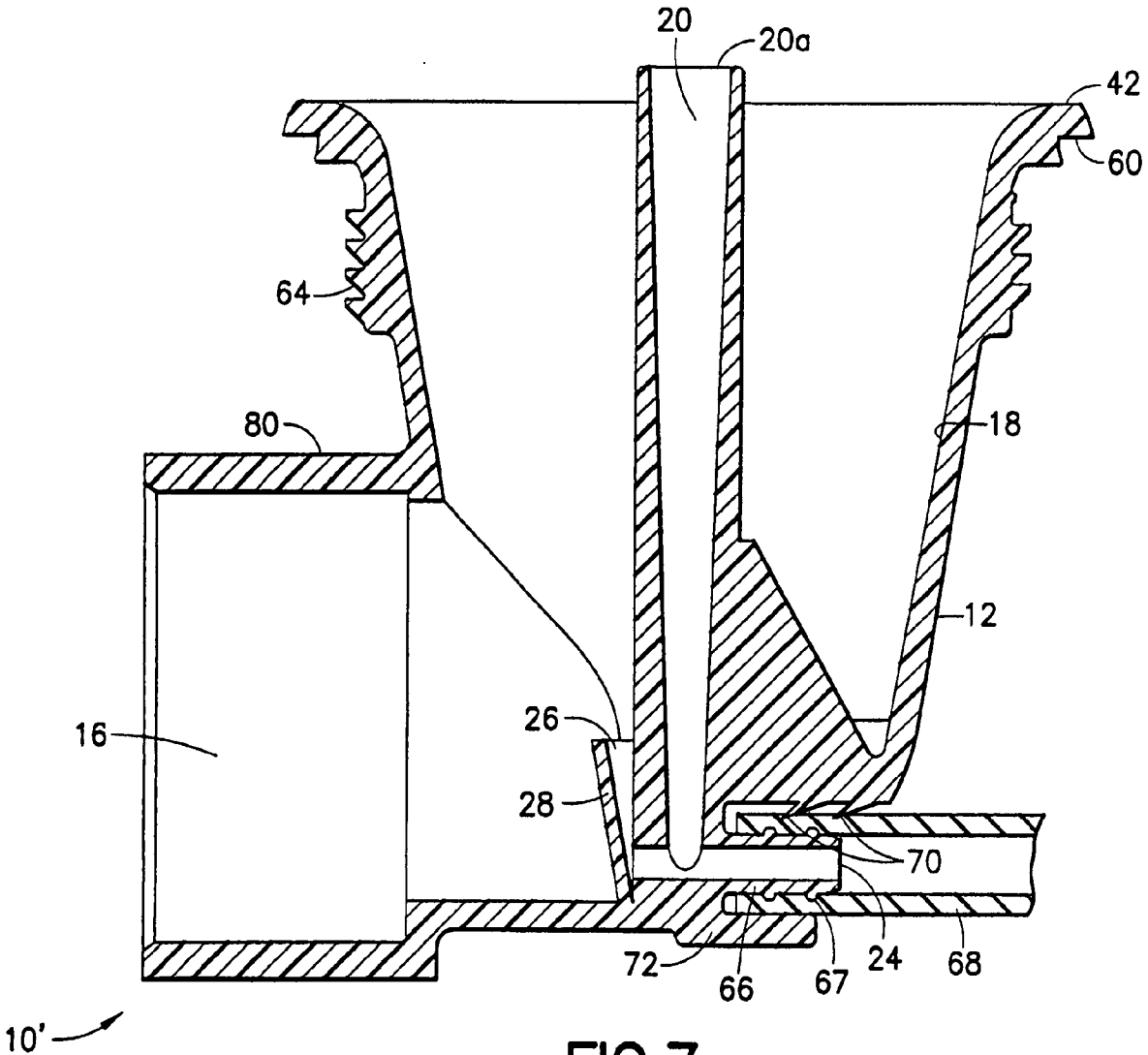
FIG. 7 shows an alternative embodiment of the present invention.

As shown in FIG. 6*d*, the annular rim 60 of the suction body 12 has one or more O-ring retainer ribs 82 for preventing the O-ring 58 from falling off during installation. In FIG. 6*b*, the suction body 12 is shown to include a rib 92 shaped to allow for water drainage.

When assembled, the suction cover 32 is attached to the elbow 80 with the screws 36 through the holes 38 into the holes 40. See FIGS. 2–4. The pressure equilibrium tube 20 is aligned with the cover 32 by means of the groove 34. The o-ring 58 is placed in the groove 60. The elbow 80 with the cover 32 assembly is inserted through a hole generally indicated as 90 (FIG. 2) in the tub or spa wall 14. The assembly 10 is attached to the tub or spa wall 14 by a nut 62. The present invention overcomes the water retention problem by incorporating the conical shape for the internal flow surface 18 once the water has left the main pipe area so that all the water will drain by gravity. The fitting or assembly 10 may be inclined up to about 10 degrees before having horizontal surfaces that will retain standing water. This allows for complete drainage. The cover 32 has numerous orifices 17 allowing water to pass through. The conical feature 28 has about a 10 degrees slope to prevent water retention in the pressure equilibrium tube 20. Under normal operation the pump (not shown) pulls water through one or more suction devices or assemblies 10 in the spa, whirlpool bathtub or other suitable water tub (not shown). The water enters the suction fitting or assembly 10 through the many orifices 17 and continues through a pipe (not shown) typically cemented to the socket 16 to the pump (not shown). The water is then discharged through the pump and re-enters the tub or spa (not shown) through jets or other devices (not shown) thus creating a water cycle. Water also enters the equilibrium tube 20 through one or more holes 19. One end of a length of flexible tubing is connected to the equilibrium tube 20, while the opposite end is connected such that it is always above the maximum water level. At any given flow up to the maximum allowable flow rate, a pressure equilibrium is created in tube 20 such that the pump (not shown) is incapable of drawing air through the tube 68 (see FIG. 7) connected to the inlet 24 whose opposite end is above the maximum water level, as discussed above. When the suction cover 32 is blocked, the flow rate will approach zero within a few seconds, the vacuum pressure approaches 29.9 inches Hg, water is drawn out of tube 20 and inlet 24, through opening 26 and into the pipe connected to the pump and socket 16. Air is pulled in after the water evacuates the tube 20 and inlet 24. The air cavitates the pump (not shown) reducing the vacuum pressure to 0 inches Hg within a few seconds. The object that is blocking the suction cover 32 may then be easily removed. The quick drop in vacuum force prevents hair entanglement, which may seriously harm a user of the spa or hot tub. Experiments have shown that a pump vacuum pressure of about 22 inches Hg can be reached with no air being drawn through the second opening until the unit is obstructed.

Finally, the other tubing material in the dry suction fitting assembly 10 may be made of PVC or other suitable material, although the scope of the invention is not intended to be limited to any particular type or kind of material. For example, embodiments are envisioned using other materials either now known or later developed in the future, including any of a class of PVC copolymers.

THE SCOPE OF THE INVENTION

It should be understood that, unless stated otherwise herein, any of the features, characteristics, alternatives or modifications described regarding a particular embodiment herein may also be applied, used, or incorporated with any other embodiment described herein.

Although the invention has been described and illustrated with respect to exemplary embodiments thereof, the foregoing and various other additions and omissions may be made therein without departing from the spirit and scope of the present invention.

The invention claimed is:

1. A dry suction fitting assembly for drawing water from a spa, whirlpool bathtub or other suitable water tub to a pump, comprising:

a suction body for arranging in relation to a wall of the spa, whirlpool bathtub or other suitable water tub, having a suction inlet for coupling to the pump, and having an internal surface with an equilibrium tube arranged therein with three openings, including a first opening that acts as a water flow inlet, a second opening that is open to the atmosphere via a connection hose or other suitable connection device and that is filled with water during normal operation, and a third opening that is a safety orifice coupled to the suction inlet, so that during normal operation water flows from the first opening, through the equilibrium tube, and out the third opening, and so that during a blockage when water stops flowing through the suction body to the suction inlet and water pressure decreases, water in the equilibrium tube evacuates out the third opening, and air is drawn from the atmosphere through the second opening and out the third opening, causing the pump to cavitate so the blockage may be removed.

2. A dry suction fitting assembly according to claim 1, wherein the internal surface has a conical member arranged in relation to the third opening that allows high pressure at the third opening to prevent premature air flow through the third opening during normal operation.

3. A dry suction fitting assembly according to claim 2, wherein the conical member has about a 10 degree slope to prevent water retention in the equilibrium tube.

4. A dry suction fitting assembly according to claim 1, wherein the internal surface has a conical shape that allows water to drain by gravity once the water has left the main pipe area of the suction body.

5. A dry suction fitting assembly according to claim 1, wherein the dry suction fitting assembly comprises a tube coupled to the second opening whose opposite end is above the maximum water level.

6. A dry suction fitting assembly according to claim 1, wherein the dry suction fitting assembly comprises a suction cover arranged on an annular rim of the suction body, the suction cover having a multiplicity of orifices for allowing water to pass into the suction body.

7. A dry suction fitting assembly according to claim 6, wherein the suction cover includes an internal groove for coupling to an annular rim of the equilibrium tube.

8. A dry suction fitting assembly according to claim 6, wherein the dry suction fitting assembly includes one or more fasteners, each fastener for passing through a respective opening in the suction cover and into a corresponding opening in the annular rim of the suction body, for coupling the suction cover to the suction body.

9. A dry suction fitting assembly according to claim 6, wherein the suction cover includes one or more male alignment members, each for coupling to a respective female alignment member in the annular rim of the suction body for orienting the suction cover in relation to the suction body.

10. A dry suction fitting assembly according to claim 1, wherein the suction body includes one or more annular rims for seating the suction body in relation to the wall of the spa, whirlpool bathtub or other suitable water tub.

11. A dry suction fitting assembly according to claim 10, wherein the dry suction fitting assembly comprises an O-ring or other suitable gasket for arranging between an annular rim of the suction body and the wall of the spa, whirlpool bathtub or other suitable water tub.

12. A dry suction fitting assembly according to claim 1, wherein the dry suction fitting assembly comprises a nut or other suitable fastening device for cooperating with threads or other suitable retaining member of the suction body for coupling the suction body to the wall of the spa, whirlpool bathtub or other suitable water tub.

13. A dry suction fitting assembly according to claim 1, wherein the suction body comprises a barb forming the second opening and adapted for coupling a tube thereto.

14. A dry suction fitting assembly according to claim 13, wherein the suction body comprises one or more hose retaining member, including teeth, arranged in relation to the barb for frictionally engaging the tube and preventing the same from pulling away from the barb.

15. A dry suction fitting assembly according to claim 13, wherein the suction body comprises a barb protecting member arranged in relation to the barb for protecting the barb.

16. A dry suction fitting assembly according to claim 1, wherein the axis of the internal surface is arranged perpendicular to the axis of the suction inlet so as to form an L-shaped suction body.

17. A dry suction fitting assembly according to claim 11, wherein the O-ring is made of Buna N, EPDM or Viton.

18. A dry suction fitting assembly according to claim 1, wherein the suction body is made of polyvinylchloride (PVC).

19. A dry suction fitting assembly according to claim 12, wherein the nut is made of PVC, the cover is made of ABS, other tubing material is made of PVC, or some combination thereof.

20. A dry suction fitting assembly according to claim 10, wherein one of the one or more annular rims of the suction body has one or more O-ring retainer ribs for preventing the O-ring from falling off during installation.

21. A dry suction fitting assembly according to claim 20, wherein the annular rim includes a plurality of O-ring retainer ribs circumferentially about the annular rim.

22. A dry suction fitting assembly according to claim 11, wherein the dry suction fitting assembly comprises an O-ring channel disposed in the annular rim for receiving the O-ring.

* * * * *